US005263706A

United States Patent [19]

Okada

[11] Patent Number: 5,263,706

[45] Date of Patent: Nov. 23, 1993

[54] MECHANISM FOR DISCHARGING SHEET MATERIALS

[75] Inventor: Mitsuharu Okada, Sakai, Japan

[73] Assignee: Mita Industrial Co., Ltd., Japan

[21] Appl. No.: 962,656

[22] Filed: Oct. 19, 1992

[30] Foreign Application Priority Data

Nov. 5, 1991 [JP] Japan ..... 3-315165

[51] Int. Cl.[5] ..... B65H 39/10

[52] U.S. Cl. ..... 271/287; 271/303; 271/279; 355/321

[58] Field of Search ..... 271/279, 303, 9, 287, 271/299, 301, 304, 305; 355/321, 322, 323; 198/442, 367; 414/794.8

[56] References Cited

U.S. PATENT DOCUMENTS

| | | | |
|---|---|---|---|
| 4,640,604 | 2/1987 | Kozuka et al. | 355/323 X |
| 4,787,616 | 11/1988 | Sasaki et al. | 271/303 X |
| 4,945,390 | 7/1990 | Hasegawa et al. | 271/303 X |

FOREIGN PATENT DOCUMENTS

| | | | |
|---|---|---|---|
| 0255326 | 11/1987 | Japan | 271/303 |
| 0213864 | 8/1990 | Japan | 355/321 |
| 0248962 | 10/1990 | Japan | 355/321 |
| 0291352 | 12/1990 | Japan | 271/303 |

*Primary Examiner*—H. Grant Skaggs
*Assistant Examiner*—Carol Lynn Druzbrick
*Attorney, Agent, or Firm*—Beveridge, DeGrandi, Weilacher & Young

[57] ABSTRACT

A discharge unit is provided on one side portion of the image-forming machine body to turn between an open position and a closed position. When the discharge unit is at the closed position, a discharge passage to the tray is defined over the discharge unit and a discharge passage to the sorter is defined under the discharge unit. When the discharge unit is turned to the open position, the lower portion of the discharge passage to the tray and the upper portion of the discharge passage to the sorter are opened.

12 Claims, 5 Drawing Sheets

MECHANISM FOR DISCHARGING SHEET MATERIALS

FIELD OF THE INVENTION

The present invention relates to a mechanism for discharging sheet materials, which is applied to an image-forming machine such as electrostatic copying machine or electrostatic printing machine.

DESCRIPTION OF THE PRIOR ART

An electrostatic copying machine equipped with a tray for receiving sheet materials and with a sorter has widely been used. Sheet materials such as common papers and sheets for OHP on which toner image has been transferred pass through a fixing device, selectively directed by a branching means to either the tray or the sorter, and are discharged. Onto the tray are discharged sheet materials of relatively large sizes that cannot be accommodated in the sorter or any size of sheet materials in the non-sorting mode. Onto the sorter are discharged, during the sorting mode, the sheet materials of sizes that can be accommodated in the sorter. Such discharge mechanisms have been disclosed in, for example, Japanese Laid-Open Patent Publication No. 147646/1980 and Japanese Laid-Open Patent Publication No. 105243/1983.

In the above-mentioned conventional mechanisms for discharging sheet materials, however, provision is made of at least a discharge passage to the tray and a discharge passage to the sorter, and a branching member is arranged at a branching position on the upstream side of the above passages. Generally, the conventional discharge mechanism has a complicated structure as a whole, because there are required a plurality of sheet material discharge passages, a number of guide plates annexed thereto, and the positioning of branching members that are installed at the innermost portion in the main body away from the one side of the copying machine. Therefore, when jamming of the sheet materials happens at the discharge passages, a cumbersome work to remove the jammed sheet materials is required consuming extended periods of time.

SUMMARY OF THE INVENTION

A principal object of the present invention, therefore, is to provide an improved mechanism for discharging sheet materials, which is capable of very easily copying with the occurrence of jamming in the discharge passage to the tray or the discharge passage to the sorter.

In order to achieve the above principal object according to the present invention, there is provided a mechanism for discharging sheet materials having the constitution, characterized in that a discharge unit is provided on a side portion of an image-forming machine body to turn between a closed position and an open position;

when said discharge unit is at said closed position, a discharge passage to the tray is defined over said discharge unit and a discharge passage to the sorter is defined under said discharge unit; and when said discharge unit is turned from said closed position to said open position, the lower portion of the discharge passage to said tray and the upper portion of the discharge passage to said sorter are opened.

Other objects of the present invention will be apparent from the detailed description of the embodiment of the mechanism for discharging sheet materials constituted according to the present invention in conjunction with the accompanying drawings.

DETAILED DESCRIPTION OF THE PREFERRED EMBODIMENT

Figure 1:
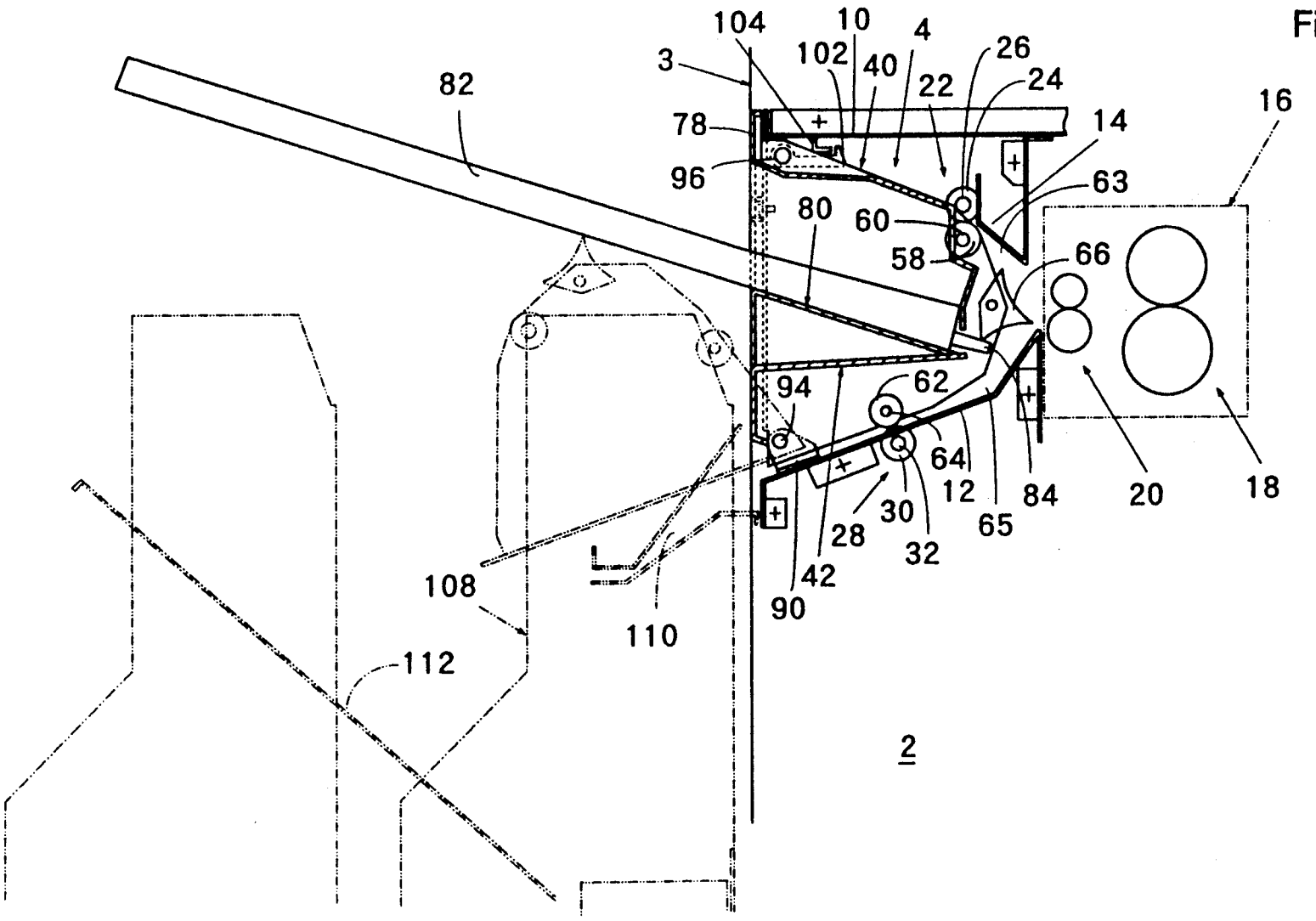
FIG. 1 is a schematic sectional view showing an embodiment of a mechanism for discharging sheet materials, that is improved according to the present invention.
Figure 2:
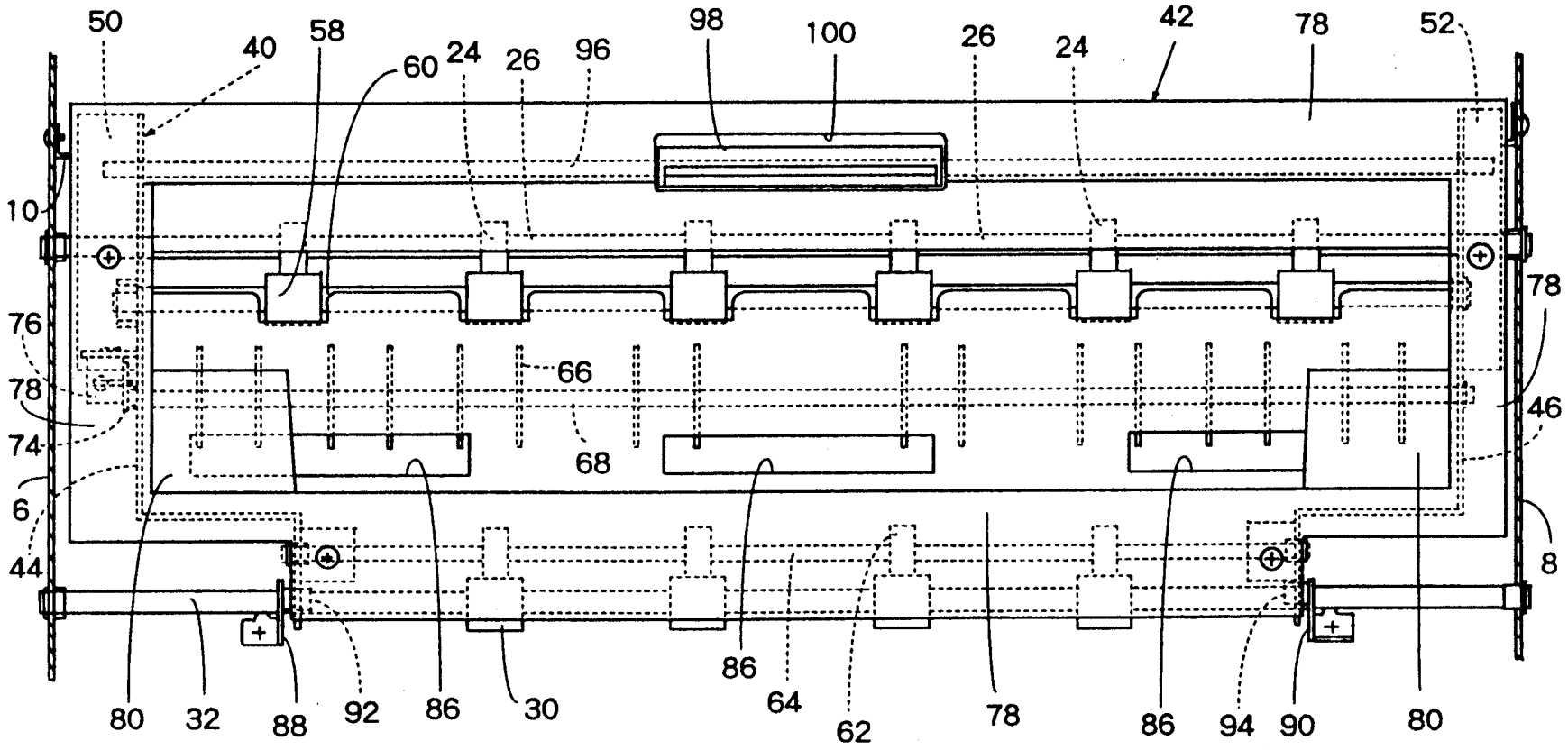
FIG. 2 is a diagram showing, partly in cross section, the major portions of FIG. 1 as viewed from the left side.
Figure 3:
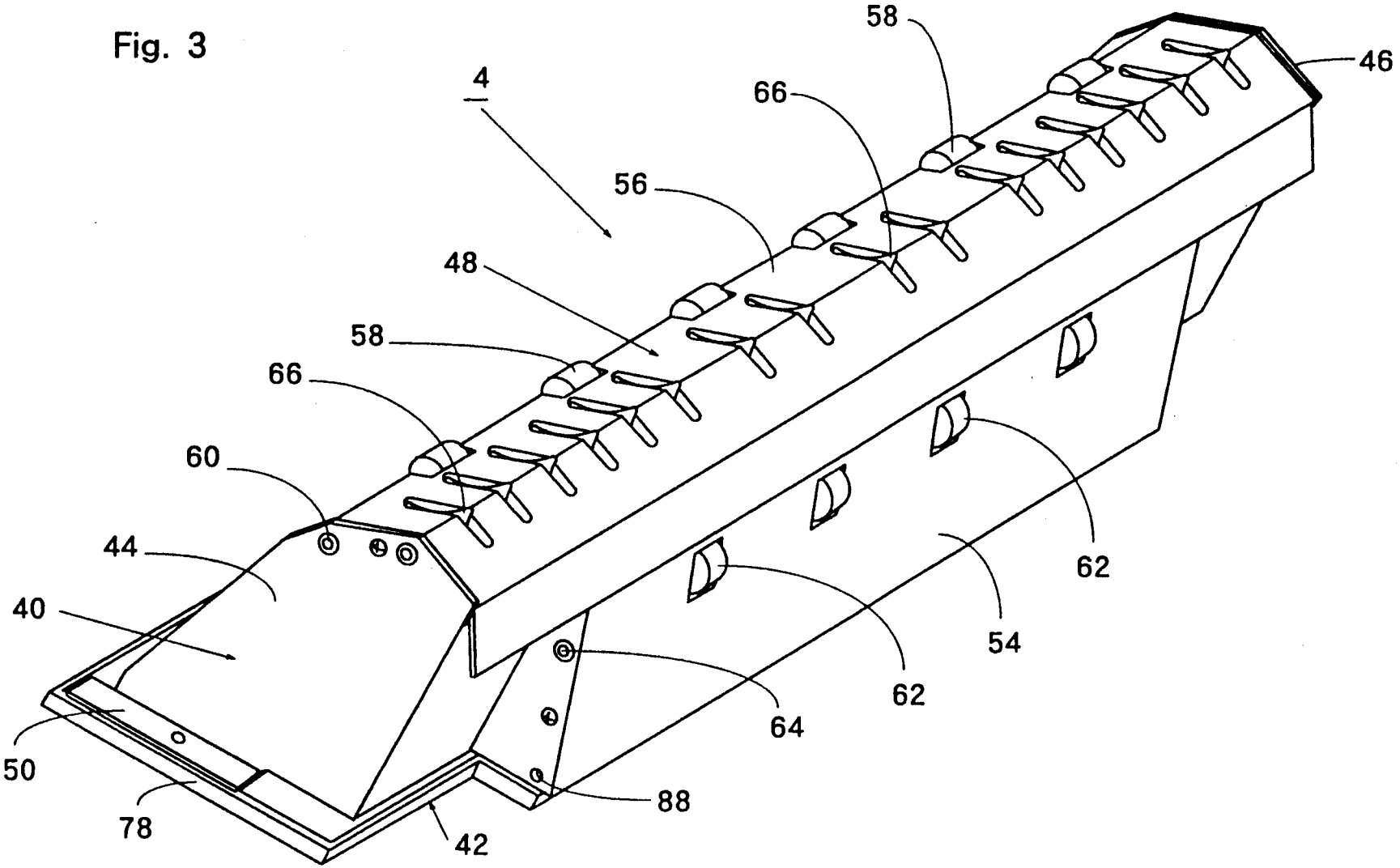
FIG. 3 is a schematic perspective view of a discharge unit shown in FIG. 1.

An embodiment of the mechanism for discharging sheet materials improved according to the present invention will be described with reference to the accompanying drawings. Referring to FIGS. 1 to 3, a predetermined opening portion that is not clearly shown is provided in one side portion 3 (FIG. 1) of an image-forming machine body 2, and a discharge unit 4 is provided in the opening portion to freely turn between a closed position and an open position.

The opening portion provided in the side portion 3 of the image-forming machine body 2 is constituted by vertical side plates 6 and 8 (see FIG. 2) that form other two side portions of the imageforming machine body 2, a horizontal base plate 10 provided across between the vertical side plates 6 and 8, a lower guide plate 12 provided across between the vertical side plates 6 and 8 under the horizontal base plate 10 at a predetermined distance with respect thereto, and an upper guide plate 14 provided across between the vertical side plates 6 and 8 on the upstream side (right side in FIG. 1) of the lower guide plate 12 at a position above it. The opening portion has an elongated shape in the width direction (in the front-and-back direction in FIG. 1 or in the right-and-left direction in FIG. 2). A predetermined gap is formed between the lower guide plate 12 and the upper guide plate 14 at the upstream ends thereof. The lower guide plate 12 is constructed so as to extend from the upstream end thereof through up to the side portion 3, which is the downstream end, of the image-forming machine body 2 and is downwardly tilted toward the downstream. The upper guide plate 14 has a downstream end that is defined at a relatively short distance from the upstream end thereof, and is upwardly tilted toward the downstream. A fixing unit 16 is disposed on the upstream side of the upstream ends of the lower guide plate 12 and the upper guide plate 14. In this embodiment, the fixing unit 16 is equipped with a pair of fixing rollers 18 and a pair of discharge rollers 20 disposed on the downstream side of the pair of fixing rollers 18.

Figure 4:
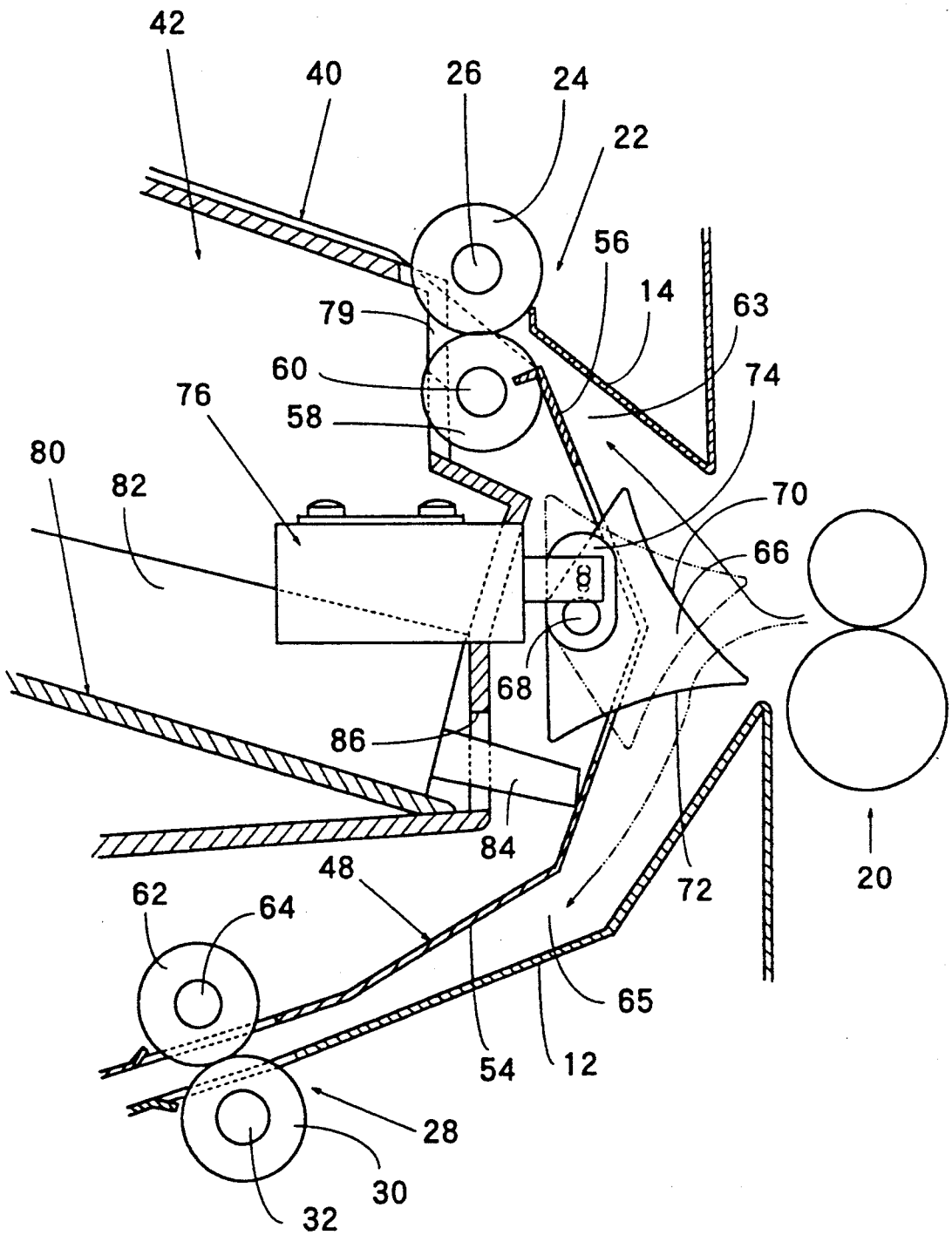
FIG. 4 is a schematic side view of major portions of a branching means including a solenoid and of the discharge passages.

At the downstream end of the upper guide plate 14 are disposed upper rollers 24 of parts of rollers 22 that carry the sheet materials to a tray 82 which will be described later. Specifically explaining, a shaft 26 is rotatably provided at the above-mentioned position across between the vertical side plates 6 and 8, and a plurality of upper rollers 24 are fitted to the shaft 26. In this embodiment the upper rollers 24 are driven rollers. At an intermediate position of the lower guide plate 12 are disposed lower rollers 30 of pairs of rollers 28 that carry the sheet materials to a sorter 108 which will be described later. Specifically explaining, a shaft 32 is rotatably provided at the above-mentioned position across between the vertical side plates 6 and 8, and a plurality of lower rollers 30 are fitted to the shaft 32. Referring to FIG. 4, the lower rollers 30 are so positioned as to be partly protruded beyond the upper surface of the lower guide plate 12 through cut-away holes that are formed at corresponding positions in the lower guide plate 12. In this embodiment, the lower rollers 30 are driving rollers which are coupled to a driving source that is not shown via a gear that is fitted to the shaft 32 but that is not shown here.

The discharge unit 4 includes a support frame 40 and a unit cover 42. The support frame 40 is constituted by a metallic plate member, and has side plates 44 and 46 that define both side portions, and a base plate 48 (refer also to FIG. 4) that couples the side plates 44 and 46 as a unitary structure. The side plates 44 and 46 form vertical side walls, and have mounting flanges 50 and 52 provided at the end portions thereof. The mounting flanges 50 and 52 are formed by bending the ends of the side plates 44 and 46 a right angles in the directions to separate away from each other. With reference to FIGS. 1 and 4, the base plate 48 includes a lower guide plate 54 and an upper guide plate 56 under a condition where the discharge unit 4 is mounted on the opening portion at the side portion 3 of the image-forming machine body 2. The lower guide plate 54 is provided at a position under the discharge unit 4, and is relatively mildly tilted upwards from the most downstream position of the discharge unit 4 toward the upstream side and is steeply tilted upwards at the upstream end thereof. The upper guide plate 56 is so constructed as to be steeply tilted upwards over a predetermined length from the upstream end of the lower guide plate 54 toward the downstream side. The support frame 40 is constituted as described above, whereby widthwisely elongated space is formed being defined by the side plates 44, 46 and the base plate 48.

Lower rollers 58 of the pairs of rollers 22 are arranged at the downstream end of the upper guide plate 56 of the support frame 40. Specifically explaining, a shaft 60 is rotatably provided at the above-mentioned position across between the side plates 44 and 46, and a plurality of lower rollers 58 are fitted to the shaft 60. In this embodiment, the lower rollers 58 are driving rollers, and the shaft 60 is provided with a gear that is not shown. Furthermore, a gear that is coupled to the driving source but that is not shown is provided at a corresponding position on the side of the imageforming machine body 2. When the discharge unit 4 is brought to the closed position in FIG. 1 as will be described later, the gear of the shaft 60 is brought in mesh with the gear on the side of the imageforming machine body 2, so that the power is transferred thereto from the driving source. Furthermore, upper rollers 62 of the pairs of rollers 28 are arranged at the intermediate position of the lower guide plate 54 of the support frame 40. Specifically explaining, a shaft 64 is rotatably provided across between the side plates 44 and 46, and a plurality of upper rollers 62 are fitted to the shaft 64. As shown in FIG. 4, the upper rollers 62 are so positioned as to be partly protruded beyond the lower surface of the lower guide plate 54 through cut-away holes that are formed at corresponding positions in the lower guide plate 54. In this embodiment, the upper rollers 62 are driven rollers.

When the discharge unit is brought to the closed position in FIG. 1, a discharge passage 63 to the tray is defined between the upper guide plate 14 and the upper guide plate 56 and a discharge passage 65 to the sorter is defined between the lower guide plate 12 and the lower guide plate 54.

With reference to FIGS. 1 and 4, the upstream end of the upper guide plate 56 and the upstream end of the lower guide plate 54 of the support frame 40 are branched at central portion thereof in the up-and-down direction. Branching members 66 are provided at the branching position. Specifically explaining, a turn shaft 68 is provided rotatably at the above-mentioned position across between the side plates 44 and 46. That is, the turn shaft 68 is disposed to extend in the width direction near the branching position on the upstream sides of the discharge passage 63 to the tray and of the discharge passage 65 to the sorter. A plurality of branching members 66 are fitted to the turn shaft 68. The branching members 66 are constituted by the plate members, and have an upper guide surface 70 that guides the sheet material discharged by the pair of discharge rollers 20 toward the discharge passage 63 to the tray and further have a lower guide surface 72 that guides them toward the discharge passage 65 to the sorter. Notches are formed at corresponding portions of the base plate 48 so as not to interrupt turning of the branching members 66. Referring to FIG. 2, an end of the turn shaft 68 protrudes beyond the side plate 44, and a lever 74 is fastened to the protruded portion. A solenoid 76 is mounted on the flange portion that protrudes sideways from the side plate 44. The moving core of the solenoid 76 and the lever 74 are coupled together by a pin. Specifically explaining, the pin is fastened to the moving core and is further inserted in an elongated hole formed in the lever 74. Under the condition where the solenoid 76 is not energized, the moving core, lever 74 and branching members 66 are located at positions of solid lines in FIG. 4, and the sheet material discharged by the pair of discharge rollers 20 is guided onto the discharge passage 63 to the tray by the upper guide surfaces 70 of the branching members 66 as indicated by an arrow of solid line. When the solenoid 76 is energized, the moving core is attracted and is leftwardly moved by a predetermined amount. As a result, the branching members 66 are turned to a position indicated by a two-dot chain line in FIG. 4. The sheet material discharged by the pair of discharge rollers 20 is guided to the discharge passage 65 to the sorter by the lower guide surfaces 72 of the branching members 66 as indicated by an arrow of two-dot chain line. The aforementioned turn shaft 68, branching members 66, lever 74, solenoid 76 and the like constitute a branching means which selectively directs the sheet material carried by the pair of discharge rollers 20 to either the discharge passage 63 to the tray or the discharge passage 65 to the sorter.

The unit cover 42 has the shape of a container which is open at one end thereof and which is elongated in the width direction, and is made of a synthetic resin. A flange portion 78 is provided along the whole circumference at the end on the open side of the unit cover 42. The flange portion 78 is fitted to the outer side of the mounting flanges 50 and 52 of the support frame 40 and is fastened thereto by screws, so that the unit cover 42 is mounted on the support frame 40. The main body of the unit cover 42 is placed in the predetermined position in space of the support frame 40. An opening 79 (FIG. 4) is formed in the main body of the unit cover 42 at a position corresponding to the pair of rollers 22. The sheet material sent by the pair of rollers 22 is discharged to the tray 82 described later through the opening 79. Receiving plates 80 of the same shape are provided at both ends in the width direction of the unit cover 42 on the open side. The receiving plates 80 are made of the synthetic resin and have a vertical portion and a tilted portion. The receiving plates 80 are fastened to the bottom wall of the unit cover 42 by screws which are not shown. The bottom at the tip of the tray 82 that receives the sheet materials is placed on the tilted portions of the receiving plates 80. At the tip of the tray 82 are provided, for example, three protruded portions 84, and three engaging holes 86 are formed at the lower end of the back wall of the unit cover 42. The protruded portions 84 of the tray 82 are inserted in the engaging holes 86 of the unit cover 42, whereby the tray 82 is stably placed on the receiving plates 80.

The discharge unit 4 thus constituted is supported in the opening portion of the image-forming machine body 2 and is allowed to turn between the closed position and the open position. The turn axis of the discharge unit 4 is so positioned as to extend in the width direction near the downstream end of the discharge passage 65 to the sorter. Specifically, support brackets 88 and 90 are provided at both side positions of the lower guide plate 12 near the downstream end on the side of the image-forming machine body 2. The side plates 44 and 46 of the discharge units 4 are positioned on the inside of the support brackets 88 and 90, the side plate 44 being rotatably supported by the support bracket 88 using a turn shaft 92 and the side plate 46 being rotatably supported by the support bracket 90 using a turn shaft 94. The turn shafts 92 and 94 are on the same axis.

Figure 5:
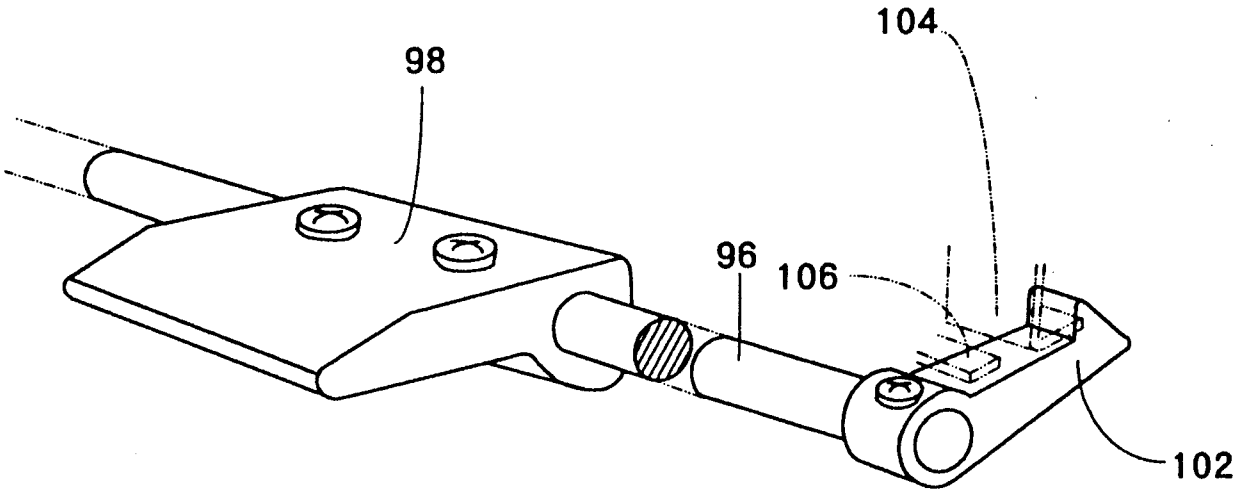
FIG. 5 is a schematic perspective view showing a portion of the locking mechanism in the discharge unit.

Provision is made of a mechanism for locking and unlocking the discharge unit 4 with respect to the opening portion of the image-forming machine body 2. With respect to FIGS. 1, 2 and 5, a turn shaft 96 that extends in the width direction is rotatably supported by the side plates 44 and 46 at a position over the discharge unit 4 on the open side (left side in FIG. 1). A grip 98 is fastened to a central portion of the turn shaft 96 in the width direction. An opening 100 is formed in a portion where the grip 98 is located (in the flange portion 78). Both ends of the turn shaft 96 protrude outwardly beyond the side plates 44 and 46, and hooks 102 are fastened to the protruded portions. The hooks have the same constitution and, hence, only one (of the side of the side plate 44) of them will be described here. A spring means that is not shown is provided between the hook 102 and the side plate 44, the hook 102 being so urged as to turn in the counterclockwise direction at all times. An engaging piece 104 is formed at a corresponding position on the horizontal base plate 10 of the image-forming machine body 2. The hook 102 is brought into engagement with the engaging piece 104 when the discharge unit 4 is turned to the closed position. The discharge unit 4 is locked to the closed position. When the turn shaft 96 is turned in the clockwise direction by using the grip 98, the hook 102 is disengaged from the engaging piece 104; i.e., the hook is unlocked. The discharge unit 4 turns from the closed position to the open position on the turn shafts 92 and 94. The side plate 44 is provided with a stop piece 106 at a position over the hook 102. Therefore, even when the grip 98 is no more held by hand at the time of turning the discharge unit 4 toward the open position, the hook 102 is prevented by the stop piece 106 from turning in the counterclockwise direction at a predetermined position.

Referring to FIG. 1, the sorter 108 which is known among people skilled in the art is disposed and is coupled at the outside of the side portion 3 of the image-forming machine body 2. Reference numeral 110 denotes a sheet material carrier passage provided for the sorter 108 and reference numeral 112 denotes one of the bins provided for the sorter 108. As required, the sorter 108 is disconnected from the side portion 3 of the image-forming machine body 2, and can be moved in a direction to separate away by a predetermined distance.

Referring to FIGS. 1 and 4, when the discharge unit 4 is at the closed position and the non-sorting mode is selected, the solenoid is not energized. The branching members 66 are at the position of solid line in FIG. 4. The sheet material discharged from the pair of discharge rollers 20 is carried onto the discharge passage 63 to the tray and is discharged by the pair of rollers 22 to the tray 82 via opening 79. When the sorting mode is selected, the solenoid 76 is energized and the branching members 66 are changed over to the position of two-dot chain line in FIG. 4. The sheet material discharged from the pair of discharge rollers 20 is carried onto the discharge passage 65 to the sorter and is discharged by the pair of rollers 28 onto the sorter 108. When the sorting mode is released, the solenoid 76 is de-energized and the branching members 66 are returned to the position of solid line.

The discharge unit 4 can be turned counterclockwisely from the closed position indicated by solid line in FIG. 1 to the open position indicated by two-dot chain line in FIG. 1 by pulling the tray 82 out of the discharge unit 4, moving the sorter 108 leftwardly in FIG. 1, and liberating the locking by using the grip 98. The above-mentioned turning of the discharge unit 4 causes the branching means which includes the lower rollers 58 of the pairs of rollers 22, upper rollers 62 of the pairs of rollers 28 and branching members 66 to move to the outside of the side portion 3 of the image-forming machine body 2. The lower portion of the discharge passage 63 to the tray is opened, the upper portion of the discharge passage 65 to the sorter is opened, and the upstream position of the branching members 66 is opened, thereby to create a wide space. In case the sheet materials are jammed in the discharge passage 63 to the tray, in the discharge passage 65 to the sorter or at the upstream position of the branching members 66, the jammed sheet materials can be removed by utilizing this wide space. The locking mechanism works as the discharge unit 4 is clockwisely turned from the open position, i.e., the discharge unit 4 is automatically held at the closed position.

Although the present invention was described above in detail by way of an embodiment, it should be noted that the invention is in no way limited to the above embodiment only but can be changed or modified in a variety of other ways without departing from the scope of the invention. For instance, it can be contrived to provide the branching means on the side of the image-forming machine body 2. In this case, the branching means is left on the side of the image-forming machine body 2 even when the discharge unit 4 is turned to the open position. However, the lower side of the discharge passage to the tray and the upper side of the discharge passage to the sorter are opened, enabling the sheet materials jammed in the discharge passages to be easily treated.

The mechanism for discharging sheet materials of the invention described above produces the following effects.

(1) When the discharge unit is turned from the closed position to the open position, the lower portion of the discharge passage to the tray and the upper portion of the discharge passage to the sorter are opened, thereby making it possible to very easily treat the jammed sheet materials. Therefore, the work load on the operator is reduced, and the jammed sheet materials can be treated within very reduced periods of time.

(2) The discharge unit that is turned from the open position to the closed position defines the discharge passage to the tray and the discharge passage to the sorter. Therefore, the discharge mechanism is very simplified.

(3) With the branching means being provided on the side of the discharge unit, the lower portion of the discharge passage to the tray, the upper portion of the discharge passage to the sorter can be widely opened and the branching portions of the discharge passages can be widely opened by turning the discharge unit from the closed position to the open position. As a result, the sheet materials jammed at the branching portions of the discharge passages can be very easily treated. (Treatment at the branching portion was difficult to carry out in the conventional mechanisms.) Therefore, the abovementioned effect (1) is further enhanced.

(4) When the discharge unit is provided with the pairs of rollers that are provided for the discharge passage to the tray and for the discharge passage to the sorter in addition to the branching means, there can be established a mechanism for discharging sheet materials that includes the discharge passage to the tray and the discharge passage to the sorter by simply assembling the discharge unit and installing it on the side portion of the image-forming machine body. Therefore, the production and the assembling of the discharge mechanism can be done easily and quickly so that its productivity is improved.

What we claim is:

1. A mechanism for discharging sheet materials, comprising:

an upper guide plate extending from a discharge opening a lower guide plate, located below said upper guide plate; and a discharge unit insertable between said upper guide plate and said lower guide plate and having an upper guide surface and a lower guide surface, such that when said discharge unit is in a closed position wherein said unit is inserted between said upper guide plate and said lower guide plate, a first discharge passage for sheet materials is formed between said upper guide surface and said upper guide plate, and a second discharge passage for sheet materials is formed between said lower guide surface and said lower guide plate, and when said discharge unit is in an open position wherein said unit is removed from between said upper guide plate and said lower guide plate, said upper guide plate and said lower guide plate are exposed.

2. A mechanism for discharging sheet materials according to claim 1, wherein said discharge unit includes a branching means for selectively directing discharged sheet materials to one of said discharge passages.

3. A mechanism for discharging sheet materials according to claim 2, wherein said branching means includes:

a turn shaft extending across a length of said discharge unit, near an upstream side of said first discharge passage and an upstream side of said second discharge passage;

a plurality of branching members fitted to said turn shaft; and a solenoid which turns said turn shaft such that said branching members direct sheet materials to one of said discharge passages.

4. A mechanism for discharging sheet materials according to claim 1, wherein said first discharge passage is provided with rollers to carry sheet materials.

5. A mechanism for discharging sheet materials according to claim 4, wherein said first discharge passage includes two pairs of rollers, one pair of rollers being supported on a side of an image-forming machine body, and the other pair of rollers being supported on a side of said discharge unit.

6. A mechanism for discharging sheet materials according to claim 1, wherein said second discharge passage is provided with rollers to carry sheet materials.

7. A mechanism for discharging sheet materials according to claim 6, wherein said second discharge passage includes two pairs of rollers, one pair of rollers being supported on a side of an image-forming machine body, and the other pair of rollers being supported on a side of said discharge unit.

8. A mechanism for discharging sheet materials according to claim 1, wherein said first discharge passage discharges sheet materials to a tray.

9. A mechanism for discharging sheet materials according to claim 1, wherein said second discharge passage discharges sheet materials to a sorter.

10. A mechanism for discharging sheet materials according to claim 1, wherein said discharge unit includes a locking mechanism for releasably locking said discharge unit in said closed position.

11. A mechanism for discharging sheet materials according to claim 1, wherein said discharge unit is rotatable between said open position and said closed position.

12. A mechanism for discharging sheet materials according to claim 14, wherein said discharge unit is rotatable about at least one shaft.

* * * * *